United States Patent [19]

Matthias

[11] Patent Number: 5,035,000

[45] Date of Patent: Jul. 30, 1991

[54] SHIRT CUFF WATCH

[76] Inventor: Jan H. Matthias, 1509 N. Beverly Dr., Beverly Hills, Calif. 90210

[21] Appl. No.: 343,787

[22] Filed: Apr. 24, 1989

[51] Int. Cl.[5] ..... A41B 7/00

[52] U.S. Cl. ..... 2/123; 224/171

[58] Field of Search ..... 2/123, 160, 162, 170, 2/160, 123; 224/164, 165, 171, 176, 180, 182; D10/32

[56] References Cited

U.S. PATENT DOCUMENTS

| | | | |
|---|---|---|---|
| 1,315,729 | 9/1919 | Jolly | 224/176 |
| 2,186,089 | 1/1940 | Baker | 224/176 X |
| 2,333,428 | 11/1943 | Kinsey | 2/160 X |
| 2,400,222 | 5/1946 | Cline | 224/165 |
| 2,538,265 | 1/1951 | Paston | 224/176 |
| 2,730,277 | 1/1956 | Aszkenas | 224/180 |
| 3,115,288 | 12/1963 | Aszkenas | 224/182 X |
| 3,552,117 | 1/1971 | Parris | 224/180 X |
| 4,103,808 | 8/1978 | Hallman et al. | 224/176 X |
| 4,213,548 | 7/1980 | Wood | 224/180 X |
| 4,387,838 | 6/1983 | Jackson | 2/160 X |

FOREIGN PATENT DOCUMENTS

| | | | |
|---|---|---|---|
| 966380 | 10/1950 | France | 224/171 |
| 109382 | 9/1917 | United Kingdom | 224/182 |
| 619116 | 3/1949 | United Kingdom | 224/171 |

*Primary Examiner*—Werner H. Schroeder
*Assistant Examiner*—Sara M. Current
*Attorney, Agent, or Firm*—Blakely, Sokoloff, Taylor & Zafman

[57] ABSTRACT

A cuff of a garment having means for displaying a standard wrist watch on the outer surface of the cuff. In a first embodiment, the cuff is provided with a pair of slit apertures through which a standard watch band is inserted. The watch band is secured around the user's wrist in a conventional manner so that only the face of the watch is exposed on the outer surface of the cuff. In a second embodiment, straps are sewn or otherwise, secured to the outer surface of the cuff, which straps are then threaded around the watch band retaining pins of a watch and inserted through slit apertures in the cuff. The straps are then secured to the inner surface of the cuff. In yet a further embodiment, straps are secured to the outer surface of the cuff and then threaded around the watch band retaining pins as above. The free ends of the straps are then secured over the attached ends of the straps on the outer surface of the cuff.

5 Claims, 2 Drawing Sheets

FIG. 1
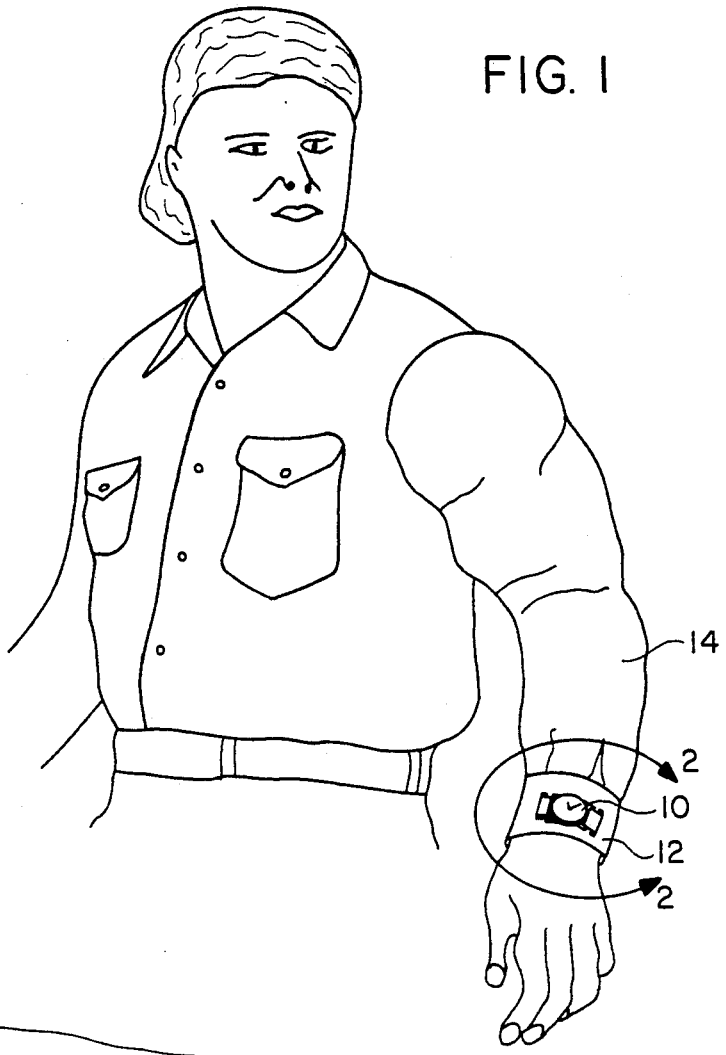
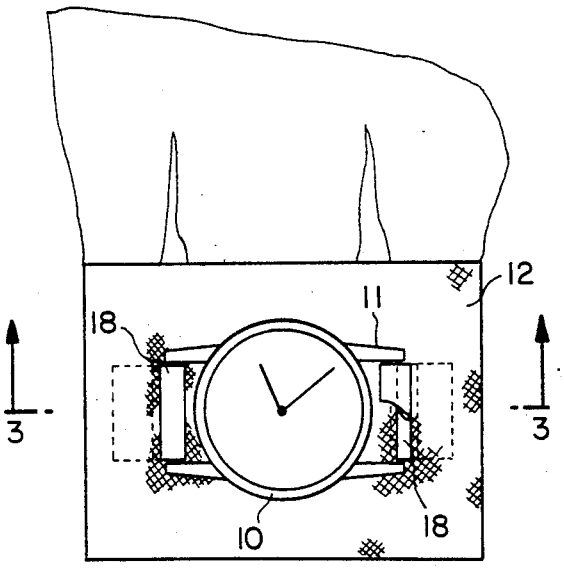
FIG. 2
FIG. 3
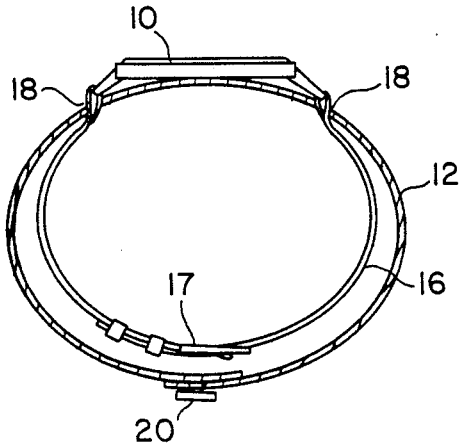

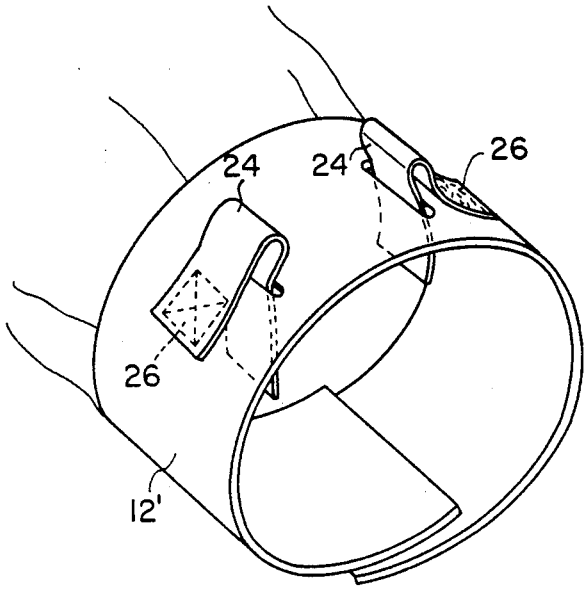
FIG. 4
FIG. 5
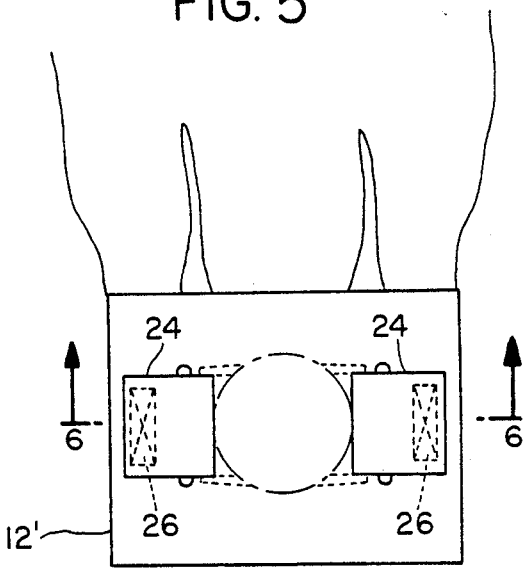
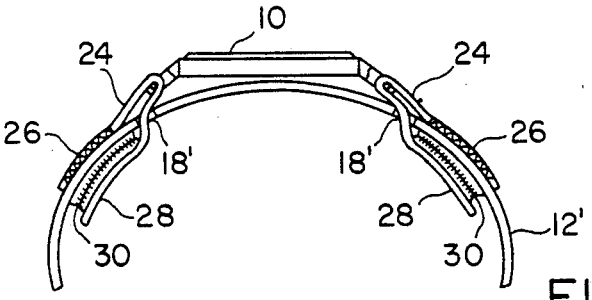
FIG. 6
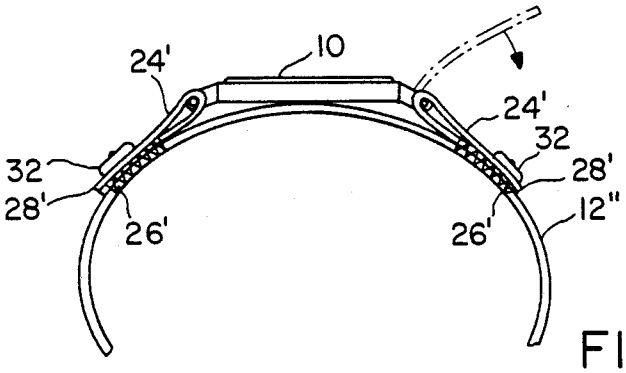
FIG. 7

SHIRT CUFF WATCH

FIELD OF THE INVENTION

This invention relates to a shirt cuff, upon the outer surface of which is worn a standard wrist watch.

BACKGROUND ART

A number of devices have been proposed for mounting a watch to an article of clothing. For example, U.S. Pat. No. 1,023,632 issued to Fantl discloses a watch having a projecting dial in the form of a button that may be inserted through an aperture in the cuff of a coat. A pocket attached to the inner surface of the cuff retains the body of the watch.

Similar means have been disclosed for attaching a watch to a glove. U.S. Pat. No. 1,271,735 issued to Lockwood shows a pocket for retaining a watch sewn to the outer surface of the glove. In a similar vein, U.S. Pat. No. 1,524,137 issued to Kastl et al. discloses a glove having an aperture for exposing a watch face and a pocket for retaining the body of the watch attached to the inner surface of the glove. More recently, U.S. Pat. No. 4,652,141 issued to Arai discloses a sports glove having a watch held by a retaining member attached to the outer surface of the glove.

Still other devices have been disclosed for attaching a watch to a belt. Such devices are shown, for example, in U.S. Pat. Nos. 1,260,539 issued to Hertz; 2,124,945 issued to Gross; 4,326,280 issued to Perry, Jr.; and 4,536,094 issued to Nagura.

None of the prior art devices disclose a means by which a standard wrist watch may be retained on the outer surface of a shirt cuff using the wristband retaining pins of the watch. Such an arrangement, as provided by the present invention, offers the advantages of having the watch face readily visible at all times (i.e. not obscured by the shirt cuff) while retaining a neat, tailored appearance. Furthermore, the present invention enables the entire case of a watch to be displayed on the outer surface of a shirt cuff rather than being hidden or partially hidden by the shirt cuff itself or by a pocket as in prior art devices.

SUMMARY OF THE INVENTION

The present invention comprises a cuff of a shirt or similar garment having means for displaying a standard wrist watch on the outer surface thereof. In a first embodiment, the cuff is provided with a pair of slit apertures through which a standard watch band is inserted. The watch band is secured around the user's wrist in a conventional manner so that only the face of the watch is exposed on the outer surface of the cuff.

In a second embodiment, straps are sewn or otherwise secured to the outer surface of the cuff, which straps are then threaded around the watch band retaining pins of a watch and inserted through slit apertures in the cuff. The straps are then secured to the inner surface of the cuff by suitable means, such as opposing pieces of hook and loop fastening material.

In yet a further embodiment of the present invention, straps are secured to the outer surface of the cuff and then threaded around the watch band retaining pins as in the second described embodiment. However, the free ends of the straps are then secured over the attached ends of the straps on the outer surface of the cuff rather than passing through apertures in the cuff.

BRIEF DESCRIPTION OF THE DRAWINGS

FIG. 1 illustrates the present invention as worn on the wrist of a user.

FIG. 2 is a detailed view of a first embodiment of the present invention.

FIG. 3 is a cross sectional view taken through line 3—3 of FIG. 2.

FIG. 4 is a perspective view of a second embodiment of the present invention.

FIG. 5 is a plan view of the embodiment illustrated in FIG. 4.

FIG. 6 is a cross sectional view taken through lines 6—6 of FIG. 5.

FIG. 7 is a cross sectional view of a third embodiment of the present invention.

DETAILED DESCRIPTION OF THE PREFERRED EMBODIMENTS

A shirt cuff for wearing a wrist watch on the outer surface of the cuff is disclosed. In the following description, for purposes of explanation and not limitation, specific numbers, dimensions, materials, etc. are set forth in order to provide a thorough understanding of the present invention. However, it will be apparent to one skilled in the art that the present invention may be practiced without these specific details.

FIG. 1 illustrates the present invention as worn by a user. Watch 10 is worn on cuff 12 of sleeve 14 of a shirt or similar garment. Although an "analog" type of watch is illustrated, it will be recognized that the present invention is suitable for use with any type of watch having ears 11 for attaching a standard watch band. Typically, ears 11 retain a pair of spring-loaded telescoping pins which may be inserted through loops at opposing ends of the watch band.

A first embodiment of the present invention is illustrated in FIGS. 2 and 3. In this embodiment, a standard watch band 16 is used to secure watch 10 on the wrist of the user. Watch band 16 is of the type that has a clasp such as buckle 17. Respective ends of watch band 16 are first inserted through slits 18 in cuff 12 and are then secured to one another around the wrist of the user by means of buckle 17. Cuff 12 is then secured by means of fastener 20.

Slits 18 are formed in cuff 12 in a manner similar to a buttonhole. Thus, slits 18 are preferably stitched around their peripheries to prevent fraying of the fabric from which cuff 12 is made. Slits 18 are large enough so that watch band 16 may be inserted therethrough with relative ease, but are not so large as to allow the case of watch 10 to pass through.

An alternative embodiment of the present invention is illustrated in FIGS. 4–6. In this embodiment, slits 18' are formed in cuff 12' as in the previously described embodiment. Straps 24, which may be made of the same or a different material as that of cuff 12, are sewn to cuff 12' at their respective ends 26.

Free ends 28 of straps 24 are inserted between ears 11 and around the watch band retaining pins of watch 10 and are then inserted through slits 18'. Fastening means, such as cooperating pieces of hook and loop material of the type sold under the trademark VELCRO, are secured to respective ends 28 of straps 24 and to the inner surface of cuff 12' opposite ends 26 of straps 24. Strap ends 28 may thus be secured to the inner surface of cuff 12', thereby retaining watch 10 on the outer surface thereof. Other types of fastening means may be used instead of the hook and loop material described. Thus, the present invention is not to be construed as limited in this regard.

Yet another alternative embodiment of the present invention is illustrated in FIG. 7. In this embodiment, straps 24' are sewn to the outer surface of sleeve 12'' as in the previously described embodiment. Free ends 28' of straps 24', however, are not inserted through slits in cuff 12''. Instead, strap ends 28' are secured to strap ends 26' by means of fasteners 32 which may be snaps, buttons or other suitable fastening devices.

It will be recognized that the above described invention may be embodied in other specific forms without departing from the spirit or essential characteristics of the disclosure. Thus, it is understood that the invention is not to be limited by the foregoing illustrative details, but rather is to be defined by the appended claims.

I claim:

1. In a garment having a cuffed sleeve to be worn in combination with a wrist watch having a pair of retaining pins attached thereto for retaining a watch band, comprising; a cuff having a pair of elongated apertures therethrough in a spaced apart relationship approximately coinciding with the spacing between said retaining pins, wherein said watch band is inserted through said elongated apertures and fastened around a wrist so that said wrist watch is displayed on an outer surface of said cuff and a majority of said watch band is between said cuff and said wrist whereby most of said watch band is hidden from view.

2. In a garment having a cuffed sleeve to be worn in combination with a wrist watch having a pair of retaining pins attached thereto for retaining a watch band, comprising;

a cuff having a pair of elongated apertures therethrough in a spaced apart relationship approximately coinciding with the spacing between said retaining pins;

a pair of retaining straps each having a first end and a second end, said first ends of said retaining straps attached to an outer surface of said cuff adjacent to said apertures; and mating fastening means for detachably fastening said second ends of said retaining straps to an inner surface of said cuff such that said inner surface of said cuff must be exposed to detach said second ends;

whereby said straps are insertable around said retaining pins in lieu of a watch band, insertable through said elongated apertures, and fastenable to said inner surface of said cuff so that said wrist watch is secured to said outer surface of said cuff.

3. The garment as recited in claim 2, wherein said mating fastening means comprises hook and loop material.

4. The garment as recited in claim 2, wherein said first ends of said retaining straps are sewn to said outer surface of said cuff adjacent to said apertures.

5. The garment as recited in claim 2, wherein said second ends of said retaining straps are detachably attached over said first ends in an overlapping fashion.

* * * * *